US010855004B2

(12) United States Patent
Hsu

(10) Patent No.: US 10,855,004 B2
(45) Date of Patent: Dec. 1, 2020

(54) COAXIAL CABLE CONNECTOR

(71) Applicant: EZCONN CORPORATION, Taipei (TW)

(72) Inventor: Yu-Hong Hsu, New Taipei (TW)

(73) Assignee: EZconn Corporation, Taipei (TW)

( * ) Notice: Subject to any disclaimer, the term of this patent is extended or adjusted under 35 U.S.C. 154(b) by 0 days.

(21) Appl. No.: 16/393,933

(22) Filed: Apr. 24, 2019

(65) Prior Publication Data

US 2019/0334257 A1 Oct. 31, 2019

(30) Foreign Application Priority Data

Apr. 25, 2018 (TW) ..... 107205408 U

(51) Int. Cl.
*H01R 9/05* (2006.01)
*H01R 24/38* (2011.01)

(52) U.S. Cl.
CPC ..... *H01R 9/0521* (2013.01); *H01R 24/38* (2013.01)

(58) Field of Classification Search
CPC .. H01R 13/622; H01R 24/40; H01R 2103/00; H01R 9/0524; H01R 9/05; H01R 9/0521; H01R 43/26; H01R 24/38; H01R 9/0518; H01R 43/20; H01R 13/6592; H01R 2201/18
See application file for complete search history.

(56) References Cited

U.S. PATENT DOCUMENTS 5,456,614 A * 10/1995 Szegda ..... H01R 9/0521 285/256
6,887,102 B1 * 5/2005 Burris ..... H01R 9/0521 439/578
7,033,195 B2 * 4/2006 Murphy ..... H01R 9/05 439/307
7,086,876 B1 * 8/2006 Montena ..... H01R 9/05 439/133
7,125,283 B1 * 10/2006 Lin ..... H01R 9/0518 439/578
7,255,598 B2 * 8/2007 Montena ..... H01R 9/0518 439/578
7,384,307 B1 * 6/2008 Wang ..... H01R 9/0524 439/394
7,544,094 B1 * 6/2009 Paglia ..... H01R 9/0518 439/585
7,618,276 B2 * 11/2009 Paglia ..... H01R 43/24 439/322

(Continued)

*Primary Examiner* — Edwin A. Leon
*Assistant Examiner* — Matthew T Dzierzynski

(57) ABSTRACT

A coaxial cable connector comprising a sleeve, nut, post, and annular flange is provided. When the post is assembled to the nut, the annular flange to the post, and post, annular flange and nut to the sleeve, a proximal post engagement portion of the post is near to a protrusion ridge of the nut, and a proximal flange engagement end of the annular flange is flush with an annular inward protrusion of the nut and post ridge and post outer surface of the post. An annular space is formed between the proximal flange engagement end and a distal flange end of the annular flange and post outer surface and a distal post tapered end of the post. A plurality of deformed indentations is formed on an inner surface of the sleeve via a plurality of engagement protrusions of the nut, each having a tapered side and a distal side.

16 Claims, 9 Drawing Sheets

(56) References Cited

U.S. PATENT DOCUMENTS

RE41,044 E * 12/2009 Hung ..... H01R 9/05 439/439
7,674,132 B1 * 3/2010 Chen ..... H01R 9/0524 439/578
7,798,849 B2 * 9/2010 Montena ..... H01R 13/622 439/583
7,806,725 B1 * 10/2010 Chen ..... H01R 9/0524 439/578
7,837,501 B2 * 11/2010 Youtsey ..... H01R 24/40 439/445
7,845,978 B1 * 12/2010 Chen ..... H01R 9/0521 439/578
7,850,487 B1 * 12/2010 Wei ..... H01R 9/0524 439/578
7,874,871 B2 * 1/2011 Montena ..... H01R 13/622 439/583
7,892,024 B1 * 2/2011 Chen ..... H01R 13/6583 439/578
7,997,930 B2 * 8/2011 Ehret ..... H01R 13/622 439/320
8,016,605 B2 * 9/2011 Montena ..... H01R 13/622 439/322
8,016,612 B2 * 9/2011 Burris ..... H01R 9/05 439/578
8,029,315 B2 * 10/2011 Purdy ..... H01R 9/0521 439/578
8,029,316 B2 * 10/2011 Snyder ..... H01R 13/622 439/578
8,062,064 B2 * 11/2011 Rodrigues ..... H01R 9/05 439/578
8,065,940 B2 * 11/2011 Wilson ..... B25B 13/06 81/467
8,075,338 B1 * 12/2011 Montena ..... H01R 24/40 439/578
8,079,860 B1 * 12/2011 Zraik ..... H01R 13/207 439/255
8,137,132 B2 * 3/2012 Lu ..... H01R 9/0524 439/578
8,152,551 B2 * 4/2012 Zraik ..... H01R 24/40 439/322
8,172,611 B1 * 5/2012 Montena ..... H01R 9/0521 439/578
8,246,392 B2 * 8/2012 Amidon ..... H01R 13/623 439/842
8,303,338 B2 * 11/2012 Chen ..... H01R 9/0518 439/578
8,323,053 B2 * 12/2012 Montena ..... H01R 9/0524 439/578
8,337,229 B2 * 12/2012 Montena ..... H01R 9/05 439/322
8,444,445 B2 * 5/2013 Amidon ..... H01R 9/0524 439/583
8,465,322 B2 * 6/2013 Purdy ..... H01R 9/0524 439/584
8,491,333 B2 * 7/2013 Evans ..... H01R 13/502 439/345
8,517,764 B2 * 8/2013 Wei ..... H01R 9/0524 439/578
8,568,164 B2 * 10/2013 Ehret ..... H01R 24/40 439/578
8,568,165 B2 * 10/2013 Wei ..... H01R 13/405 439/578
8,568,167 B2 * 10/2013 Montena ..... H01R 9/0524 439/578
8,864,519 B2 * 10/2014 Wei ..... H01R 13/405 439/578
9,306,324 B2 * 4/2016 Wei ..... H01R 13/622
9,343,855 B2 * 5/2016 Wei ..... H01R 24/40
9,837,777 B1 * 12/2017 Blake ..... H01R 43/26
9,859,669 B2 * 1/2018 Chen ..... H01R 24/40
9,929,498 B2 * 3/2018 Thakare ..... H01R 13/622
9,929,499 B2 * 3/2018 Thakare ..... H01R 13/622
10,103,459 B2 * 10/2018 Chen ..... H01R 9/0521
2008/0066584 A1 * 3/2008 Vines ..... B25B 13/06 81/124.2
2010/0199813 A1 * 8/2010 Phillips ..... B25B 13/06 81/124.2

* cited by examiner

COAXIAL CABLE CONNECTOR

RELATED APPLICATIONS

The present application claims priority to Taiwan application no. 107205408, filed on Apr. 25, 2018, of which is hereby incorporated by reference in its entirety.

BACKGROUND OF THE INVENTION

Field of the Invention

The invention relates to connectors, and more particularly, to coaxial cable connectors.

Description of the Related Art

TV service types are dominated by cord connected services. These cord connected services utilize coaxial cables for connection, employing connectors such as twistable F-type connectors. Twistable F-type connectors are used for connection with cable TV decoders, digital video recorders and DVD recorders, satellite receivers, video game systems, distribution amplifiers or signal splitters, and switching boxes etc., having a mounting means built therein.

Conventional coaxial cable connectors generally comprise a connector body having a post which is able to house a coaxial cable therethrough, a nut, rotatably coupled to the post, mounting the conventional coaxial cable connector to an apparatus or device having a mounting means built therein, and an annular flange, between the post and nut.

An o-ring may also be placed between the post and nut at a rotatable portion therebetween, for waterproof sealing.

The post of conventional coaxial cable connectors, generally comprise a coaxial cable receiving end, receiving a coaxial cable therethrough and a coaxial cable connecting end, opposite thereto. The nut of conventional coaxial cable connectors, generally further comprise internal threads, at the coaxial cable connecting end, having a width compatible for mounting the conventional coaxial cable connectors to an apparatus or device having a mounting means built therein.

Conventional coaxial cable connectors generally further comprise a sleeve, securing the coaxial cable positioned within the connector body of the conventional coaxial cable connector. The sleeve of conventional coaxial cable connectors is basically formed of an elastic plastic material and is fixed to the connector body of the conventional coaxial cable connector. In short, the conventional coaxial cable connector is a fixed-type structural sleeve design having a rotatable nut.

There is demand for coaxial cable connectors to solve the aforementioned problems.

BRIEF SUMMARY OF THE INVENTION

Coaxial cable connectors are provided.

In an embodiment, a coaxial cable connector comprises a sleeve, nut, post, fixing washer, and annular flange. The post has a proximal post engagement portion surrounding a proximal post interior opening, proximal post outer surface, post ridge, post outer surface, and distal post tapered end surrounding a distal post interior opening. The fixing washer has a fixing washer ring and a plurality of fixing appendages, wherein each of the plurality of fixing appendages comprises an elastic wing and an opening space. The nut has a plurality of nut sides surrounding a distal nut interior opening, opposite a proximal nut interior opening, and a plurality of engagement protrusions between the plurality of nut sides.

In an embodiment, the nut further comprises an annular inward protrusion having a protrusion ridge, a tapered protrusion surface, and a protrusion surface.

In the embodiment, the fixing washer is assembled to the proximal post engagement portion and proximal post outer surface of the post via the distal post tapered end and the post and the fixing washer are assembled to the nut via the proximal nut interior opening. When assembled, the proximal post engagement portion of the post is near to the protrusion ridge of the nut and the elastic wing of each of the plurality of fixing appendages is in contact with the tapered protrusion surface of the nut.

In an alternative embodiment, the plurality of fixing appendages are perpendicular to the fixing washer ring, and the elastic wing extends from a top portion of each of the plurality of fixing appendages at an outward angle. When the fixing washer is assembled to the post, the elastic wing of each of the plurality of fixing appendages are in contact with the tapered protrusion surface of the nut, and when the nut is moved, the outward angle of the elastic wing is varied.

In the embodiment, each of the plurality of engagement protrusions comprise a tapered side and a distal side, the tapered side, positioned toward the proximal nut interior opening, has an outer angle that is greater than an outer angle of the distal side. The annular flange has a proximal flange engagement end surrounding a proximal flange interior opening, proximal channel, first proximal outer surface, second proximal outer surface, a central outer annular flange, and a distal flange end surrounding a distal flange interior opening. The sleeve has a proximal sleeve engagement portion surrounding a proximal sleeve interior opening and a distal sleeve interior portion surrounding a distal sleeve interior opening. The proximal sleeve engagement portion comprises a proximal sleeve interior portion.

In an alternative embodiment, the shape of the tapered and distal sides of the plurality of engagement protrusions is triangular prism-shaped. In another alternative embodiment, the angle of the tapered side of the plurality of engagement protrusions is between 105° degrees and 170° degrees.

In an alternative embodiment, the distal sleeve interior opening of the sleeve is polygonal-shaped. In another alternative embodiment, the sleeve further comprises a direction indicator disposed on an outer surface of the proximal sleeve engagement portion.

In the embodiment, the annular flange is assembled to the post, having the fixing washer assembled thereto, and assembled to the nut, via the proximal flange interior opening. The post, fixing washer, nut and annular flange, are assembled to the proximal sleeve interior portion of the sleeve via the distal sleeve interior opening. When assembled, the proximal flange engagement end is flush with the annular inward protrusion of the nut and post ridge and post outer surface of the post. An annular space is formed between the proximal flange engagement end and distal flange end of the annular flange and post outer surface and distal post tapered end of the post. A plurality of deformed indentations is formed on an inner surface of the sleeve via the plurality of engagement protrusions of the nut.

In the embodiments, the coaxial cable connector comprises the fixing washer; however, the embodiments are not limited thereto. In an alternative embodiment, the coaxial cable connector comprises a sleeve, nut, post, and annular flange, and not the fixing washer, wherein the disposition and assembly of the post to the nut, annular flange to the post and nut, and post, nut, and annular flange to the sleeve, is as described previously, without the description of the fixing washer. As an example, in the embodiment, with no fixing washer assembled to the proximal post engagement portion and proximal post outer surface of the post, the post, alone, is assembled to the nut via the proximal nut interior opening. When assembled, the proximal post engagement portion of the post is near to the protrusion ridge of the nut and the tapered protrusion surface of the nut.

In an embodiment, a nut, configured as a part of a coaxial cable connector, comprising a plurality of nut sides and a plurality of engagement protrusions is provided. The plurality of nut sides surrounds a distal nut interior opening, opposite a proximal nut interior opening. The plurality of engagement protrusions are between the plurality of nut sides. Each of the plurality of engagement protrusions comprises a tapered side and a distal side. The tapered side, positioned toward the proximal nut interior opening, has an outer angle that is greater than an outer angle of the distal side.

In the embodiment, the coaxial cable connector further comprises a sleeve, post, fixing washer, and annular flange. The post has a proximal post engagement portion surrounding a proximal post interior opening, proximal post outer surface, post ridge, post outer surface, and distal post tapered end surrounding a distal post interior opening. The fixing washer has a fixing washer ring and a plurality of fixing appendages, wherein each of the plurality of fixing appendages comprises an elastic wing and an opening space.

In the embodiment, the fixing washer is assembled to the proximal post engagement portion and proximal post outer surface of the post via the distal post tapered end and the post and the fixing washer are assembled to the nut via the proximal nut interior opening. When assembled, the proximal post engagement portion of the post is near to the protrusion ridge of the nut and the elastic wing of each of the plurality of fixing appendages is in contact with the tapered protrusion surface of the nut.

In an alternative embodiment, the plurality of fixing appendages are perpendicular to the fixing washer ring, and the elastic wing extends from a top portion of each of the plurality of fixing appendages at an outward angle. When the fixing washer is assembled to the post, the elastic wing of each of the plurality of fixing appendages are in contact with the tapered protrusion surface of the nut, and when the nut is moved, the outward angle of the elastic wing is varied.

In the embodiment, the nut further comprises an annular inward protrusion having a protrusion ridge, a tapered protrusion surface, and a protrusion surface. The annular flange has a proximal flange engagement end surrounding a proximal flange interior opening, proximal channel, first proximal outer surface, second proximal outer surface, a central outer annular flange, and a distal flange end surrounding a distal flange interior opening. The sleeve has a proximal sleeve engagement portion surrounding a proximal sleeve interior opening and a distal sleeve interior portion surrounding a distal sleeve interior opening. The proximal sleeve engagement portion comprises a proximal sleeve interior portion.

In an alternative embodiment, the shape of the tapered and distal sides of the plurality of engagement protrusions is triangular prism-shaped. In another alternative embodiment, the angle of the tapered side of the plurality of engagement protrusions is between 105° degrees and 170° degrees.

In an alternative embodiment, the distal sleeve interior opening of the sleeve is polygonal-shaped.

In the embodiment, the annular flange is assembled to the post, having the fixing washer assembled thereto, and assembled to the nut, via the proximal flange interior opening. The post, fixing washer, nut and annular flange, are assembled to the proximal sleeve interior portion of the sleeve via the distal sleeve interior opening. When assembled, the proximal flange engagement end is flush with the annular inward protrusion of the nut and post ridge and post outer surface of the post. An annular space is formed between the proximal flange engagement end and distal flange end of the annular flange and post outer surface and distal post tapered end of the post. A plurality of deformed indentations is formed on an inner surface of the sleeve via the plurality of engagement protrusions of the nut.

In the embodiments, the coaxial cable connector comprises the fixing washer; however, the embodiments are not limited thereto. In an alternative embodiment of the nut, configured as a part of a coaxial cable connector, the coaxial cable connector comprises a sleeve, nut, post, and annular flange, and not the fixing washer, wherein the disposition and assembly of the post to the nut, annular flange to the post and nut, and post, nut, and annular flange to the sleeve, is as described previously, without the description of the fixing washer. As an example, in the embodiment, with no fixing washer assembled to the proximal post engagement portion and proximal post outer surface of the post, the post, alone, is assembled to the nut via the proximal nut interior opening. When assembled, the proximal post engagement portion of the post is near to the protrusion ridge of the nut and the tapered protrusion surface of the nut.

In an embodiment, a sleeve, configured as a part of a coaxial cable connector, comprising a proximal sleeve engagement portion, distal sleeve interior portion, first conical flat surface, second conical flat surface, first semi-arching surface, and second semi-arching surface is provided. The proximal sleeve engagement portion surrounds a proximal sleeve interior opening, having a proximal sleeve interior portion. The distal sleeve interior portion surrounds a polygonal-shaped distal sleeve interior opening. The first conical flat surface has a plurality of first bumps thereon. The second conical flat surface, opposite the first conical flat surface, has a plurality of second bumps thereon. A first semi-arching surface between the first and second conical flat surfaces has a plurality of first semi-curved protrusions thereon. The second semi-arching surface, opposite the first semi-arching surface, has a plurality of second semi-curved protrusions thereon.

In the embodiment, the coaxial cable connector further comprises a nut, a post, and an annular flange. The nut has a plurality of nut sides surrounding a distal nut interior opening, opposite a proximal nut interior opening, and a plurality of engagement protrusions between the plurality of nut sides. Each of the plurality of engagement protrusions comprises a tapered side and a distal side. The tapered side, positioned toward the proximal nut interior opening, has an outer angle that is greater than an outer angle of the distal side.

In an alternative embodiment, the nut has a plurality of nut sides surrounding a distal nut interior opening, opposite a proximal nut interior opening, and a plurality of engagement protrusions between the plurality of nut sides. Each of the plurality of engagement protrusions comprises a tapered side and a distal side. The tapered side, positioned toward the proximal nut interior opening, has an outer angle that is greater than an outer angle of the distal side. In another alternative embodiment, the shape of the tapered and distal sides of the plurality of engagement protrusions is triangular prism-shaped.

In the embodiment, the post has a proximal post engagement portion surrounding a proximal post interior opening, proximal post outer surface, post ridge, post outer surface, and distal post tapered end surrounding a distal post interior opening. The annular flange has a proximal flange engagement end surrounding a proximal flange interior opening, proximal channel, first proximal outer surface, second proximal outer surface, a central outer annular flange, and a distal flange end surrounding a distal flange interior opening. In an embodiment, the nut further comprises an annular inward protrusion having a protrusion ridge, a tapered protrusion surface, and a protrusion surface.

In the embodiment, the post is assembled to the nut via the proximal nut interior opening. When assembled, the proximal post engagement portion is near to the protrusion ridge of the nut. The annular flange is assembled to the post and the nut via the proximal flange interior opening of the annular flange. When assembled, the proximal flange engagement end is flush with the annular inward protrusion of the nut and post ridge and post outer surface of the post. An annular space is formed between the proximal flange engagement end and distal flange end of the annular flange and post outer surface and distal post tapered end of the post. The nut, post, and annular flange are assembled to the proximal sleeve interior portion of the sleeve via the distal sleeve interior opening. When assembled, a plurality of deformed indentations is formed on an inner surface of the sleeve via the plurality of engagement protrusions of the nut.

These, as well as other components, steps, features, benefits, and advantages of the present application, will now made clear by reference to the following detailed description of the embodiments, the accompanying drawings, and the claims.

BRIEF DESCRIPTION OF THE DRAWINGS

The accompanying drawings, which are incorporated herein and form a part of the Detailed Description of the Invention, illustrate various embodiments of the present invention and, together with the Detailed Description of the Invention, serve to explain principles discussed below. The drawings referred to in this Brief Description of Drawings should not be understood as being drawn to scale unless specifically noted.

DETAILED DESCRIPTION OF THE INVENTION

Figure 1A:
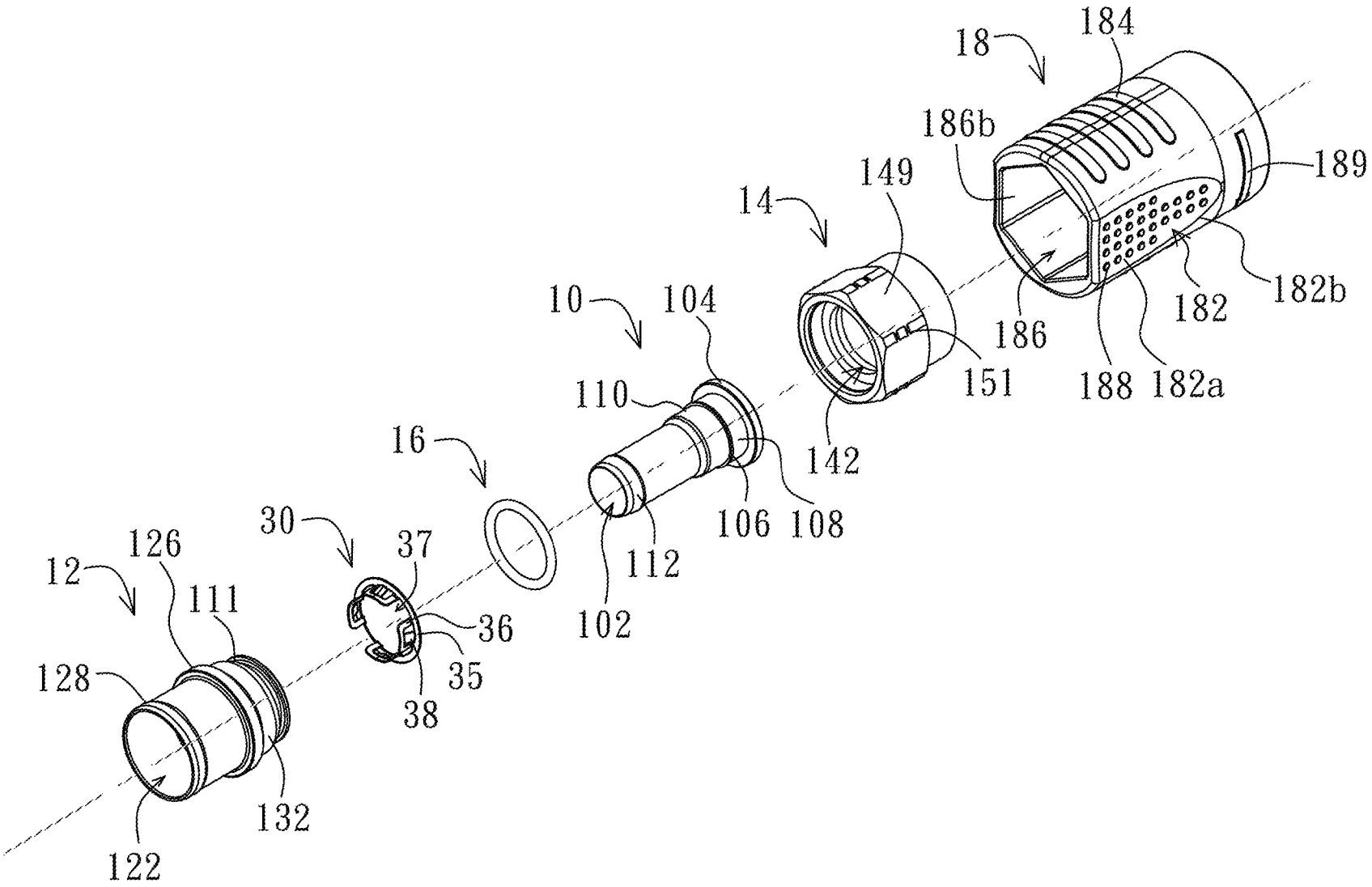
FIG. 1A is an exploded view illustrating a coaxial cable connector according to various embodiments.

It is understood that the following disclosure provides many different embodiments, or examples, for implementing different features of the invention. Specific examples of devices and arrangements are described below to simplify the present disclosure. These are, of course, merely examples and are not intended to be limiting. For example, the formation of a first feature over or on a second feature in the description that follows can include embodiments in which the first and second features are formed in direct contact, and can also include embodiments in which additional features are formed between the first and second features, such that the first and second features are not in direct contact. In addition, the present disclosure can repeat reference numerals and/or letters in the various examples. This repetition is for the purpose of simplicity and clarity and does not in itself dictate a relationship between the various embodiments and/or configurations discussed. It is intended that the scope of the present technology be defined by the claims appended hereto and their equivalents.

In the embodiments, a coaxial cable connector comprising a sleeve, nut, post, and annular flange is provided. When the post is assembled to the nut, the annular flange to the post, and post, annular flange and nut to the sleeve, a proximal post engagement portion of the post is near to a protrusion ridge of the nut, and a proximal flange engagement end of the annular flange is flush with an annular inward protrusion of the nut and post ridge and post outer surface of the post. An annular space is formed between the proximal flange engagement end and a distal flange end of the annular flange and post outer surface and a distal post tapered end of the post. A plurality of deformed indentations is formed on an inner surface of the sleeve via a plurality of engagement protrusions of the nut, each having a tapered side and a distal side.

Figure 1B:
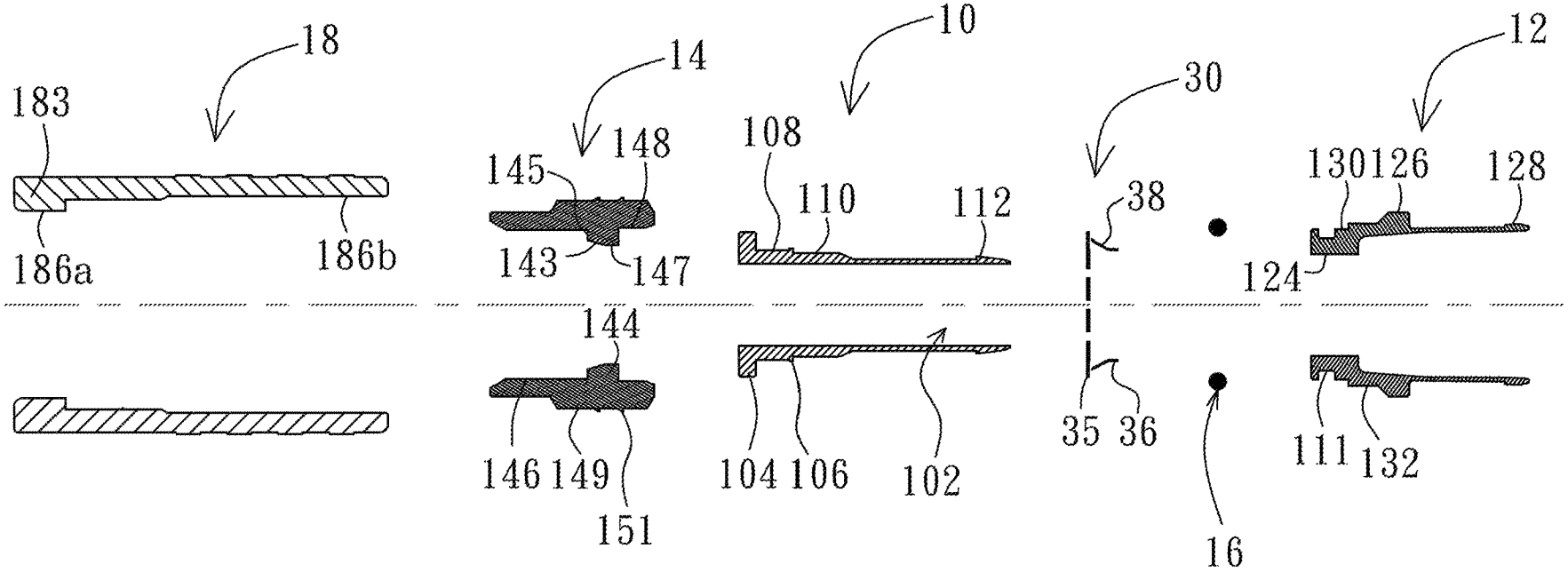
FIG. 1B is an exploded cross-sectional sliced view illustrating a coaxial cable connector according to various embodiments.
Figure 1C:
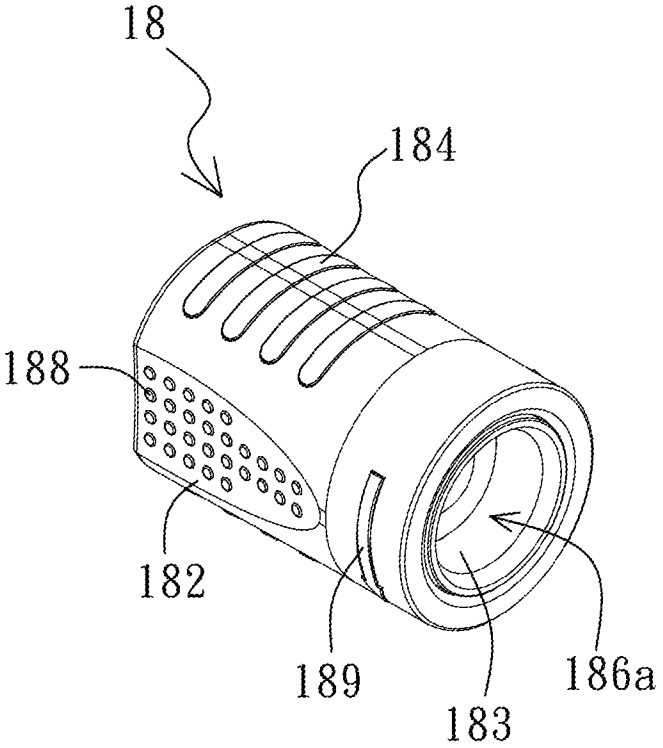
FIG. 1C is a perspective view illustrating a sleeve of a coaxial cable connector according to various embodiments.
Figure 1D:
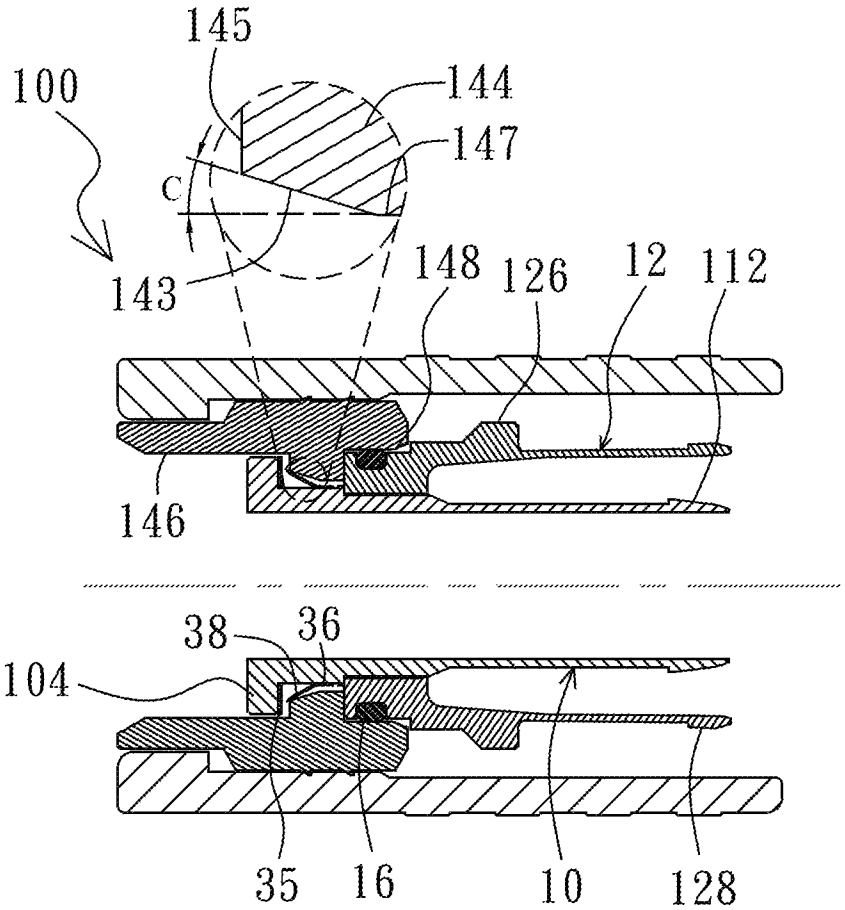
FIG. 1D is a cross-sectional sliced view illustrating a coaxial cable connector according to various embodiments.

FIG. 1A is an exploded view illustrating a coaxial cable connector according to various embodiments. FIG. 1B is an exploded cross-sectional sliced view illustrating a coaxial cable connector according to various embodiments. FIG. 1C is a perspective view illustrating a sleeve 18 of a coaxial cable connector according to various embodiments. FIG. 1D is a cross-sectional sliced view illustrating a coaxial cable connector according to various embodiments. As shown in FIGS. 1A to 1D, in an embodiment, a coaxial cable connector comprises a sleeve 18, nut 14, post 10, fixing washer 30, and annular flange 12. The material of the nut 14, post 10, fixing washer 30, and annular flange 12 may comprise electrically conductive material such as copper, bismuth, silver, nickel, tin, gold, copper gold-alloy, copper tin-alloy, copper nickel-alloy, or good electrically conductive polymer, or non-metal conductor etc. The surface of the nut 14, post 10, fixing washer 30, and annular flange 12, may be covered with an antitrust layer or have an electroless plating process performed thereto. The material of the sleeve 18 may comprise rubber material, or soft polymaterial, or other elastic and waterproof sealing polymaterial etc.

The post 10 has a proximal post engagement portion 104 surrounding a proximal post interior opening, proximal post outer surface 108, post ridge 106, post outer surface 110, and distal post tapered end 112 surrounding a distal post interior opening 102. The fixing washer 30 has a fixing washer ring 35 and a plurality of fixing appendages 36, wherein each of the plurality of fixing appendages 36 comprises an elastic wing 38 and an opening space 39. The nut 14 has a plurality of nut sides 149 surrounding a distal nut interior opening 142, opposite a proximal nut interior opening, and a plurality of engagement protrusions 151 between the plurality of nut sides 149.

In the embodiments, the diameter of the distal nut interior opening 142 is greater than the distal post tapered end 112 and post ridge 106, but smaller than the proximal post engagement portion 104.

In the embodiments, the thickness of the fixing washer ring 35, plurality of fixing appendages 36, and each elastic wing 38 is 0.05 to 0.50 millimetres or 0.03 to 1 millimetres.

In the embodiments, the fixing washer 30 further comprises a hollow interior 37 therethrough and the plurality of fixing appendages 36 and elastic wing 38 are integrally formed.

In the embodiments, the plurality of fixing appendages 36 of the fixing washer 30 has one elastic wing 38 and an opening space 39; however the embodiments are not limited thereto. In alternative embodiments, the plurality of fixing appendages 36 of the fixing washer 30 may have more than one elastic wing 38 and opening space 39. As an example, and not to be limiting, two to four elastic wings and opening spaces.

In the embodiments, the shape of the plurality of fixing appendages 36 is arch-shaped; however, the embodiments are not limited thereto. In alternative embodiments, the shape may be square-shaped, rectangular-shaped, semi-circular-shaped or polygonal shaped etc.

In the embodiments, the shape of the elastic wing 38 is arch-shaped; however, the embodiments are not limited thereto. In alternative embodiments, the shape may be square-shaped, rectangular-shaped, semi-circular-shaped or polygonal shaped etc.

In the embodiments, the surface of the elastic wing 38 may be smooth, rough, perforated, or the like etc.

In an embodiment, the nut 14 further comprises an annular inward protrusion 144 having a protrusion ridge 145, a tapered protrusion surface 143, and a protrusion surface 147.

In an embodiment, the nut 14 further comprises a distal nut end portion 148 and a threaded portion 146. The annular inward protrusion 144 is between the distal nut end portion 148 and a threaded portion 146.

In the embodiments, the type of the nut 14 may be hex nuts, square nuts, ring nut, wing nuts, or the like, so long as manual or assisted twisting can be applied to mount the coaxial cable connector to an apparatus or device having a mounting means built therein.

In the embodiment, the fixing washer 30 is assembled to the proximal post engagement portion 104 and proximal post outer surface 108 of the post 10 via the distal post tapered end 112 and the post 10 and the fixing washer 30 are assembled to the nut 14 via the proximal nut interior opening. When assembled, the proximal post engagement portion 104 of the post 10 is near to the protrusion ridge 145 of the nut 14 and the elastic wing 38 of each of the plurality of fixing appendages 36 is in contact with the tapered protrusion surface 143 of the nut 14.

In the embodiments, the nut 14 is rotatable when in contact with the elastic wing 38 of each of the plurality of fixing appendages 36 and post ridge 106 of the post 10, and when the elastic wing 38 of each of the plurality of fixing appendages 36 is assembled to the proximal post engagement portion 104 and proximal post outer surface 108 of the post 14.

In the embodiments, an angle C, formed between the plane of the protrusion surface 147 and tapered protrusion surface 143, may be between 15° degrees to 60° degrees, between 10° degrees to 30° degrees, or between 20° degrees to 45° degrees.

Figure 2C:
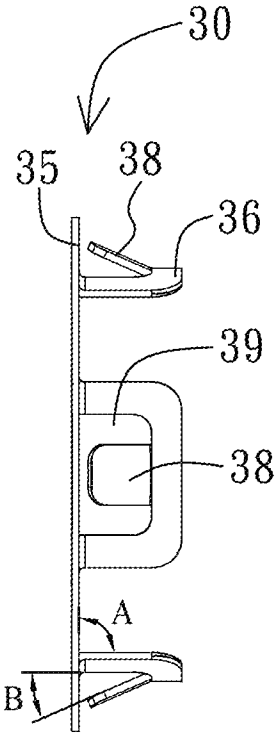
FIG. 2C is a perspective side view illustrating a fixing washer of a coaxial cable connector according to various embodiments.
Figure 2B:
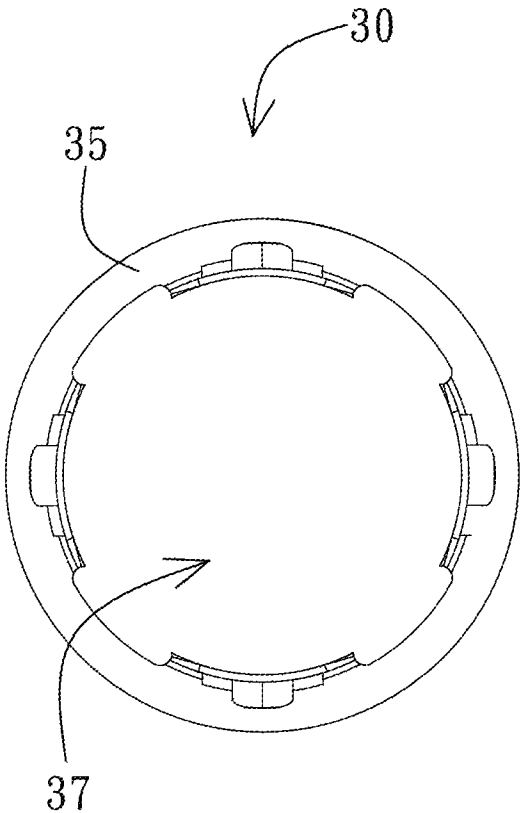
FIG. 2B is a perspective top view illustrating a fixing washer of a coaxial cable connector according to various embodiments.
Figure 2A:
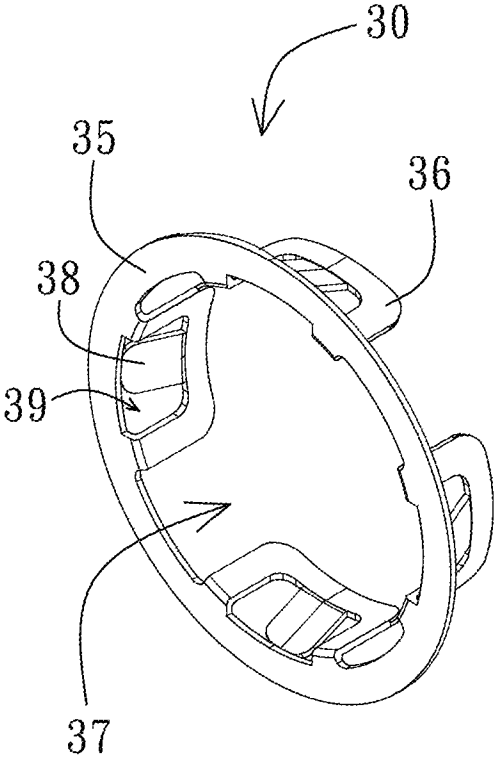
FIG. 2A is a perspective side angled view illustrating a fixing washer of a coaxial cable connector according to various embodiments.

FIG. 2A is a perspective side angled view illustrating a fixing washer of a coaxial cable connector according to various embodiments. FIG. 2B is a perspective top view illustrating a fixing washer of a coaxial cable connector according to various embodiments. FIG. 2C is a perspective side view illustrating a fixing washer of a coaxial cable connector according to various embodiments. As shown in FIGS. 2A to 2B, and referring to FIGS. 1A to 1D, in an alternative embodiment, the plurality of fixing appendages 36 is perpendicular to the fixing washer ring 35; however, the embodiments are not limited thereto. In other alternative embodiments, the plurality of fixing appendages 36 may be at a predetermined angle A, such as between 90° degrees to 120° degrees, between 90° degrees to 100° degrees, or between 90° degrees to 95° degrees. In the embodiment, the plurality of fixing appendages 36 are separated by a space and the elastic wing 38 extends from a top portion of each of the plurality of fixing appendages 36 at an outward angle. When the fixing washer 30 is assembled to the post 10, the elastic wing 38 of each of the plurality of fixing appendages 36 are in contact with the tapered protrusion surface 143 of the nut 14, and when the nut 14 is moved, the outward angle of the elastic wing 38 is varied.

In the embodiments, the angle of the arch of the separated spaces of the plurality of fixing appendages 36 may be between 10° degrees to 30° degrees, between 20° degrees to 45° degrees, between 60° degrees to 150° degrees, or between 60° degrees to 120° degrees.

Figure 3:
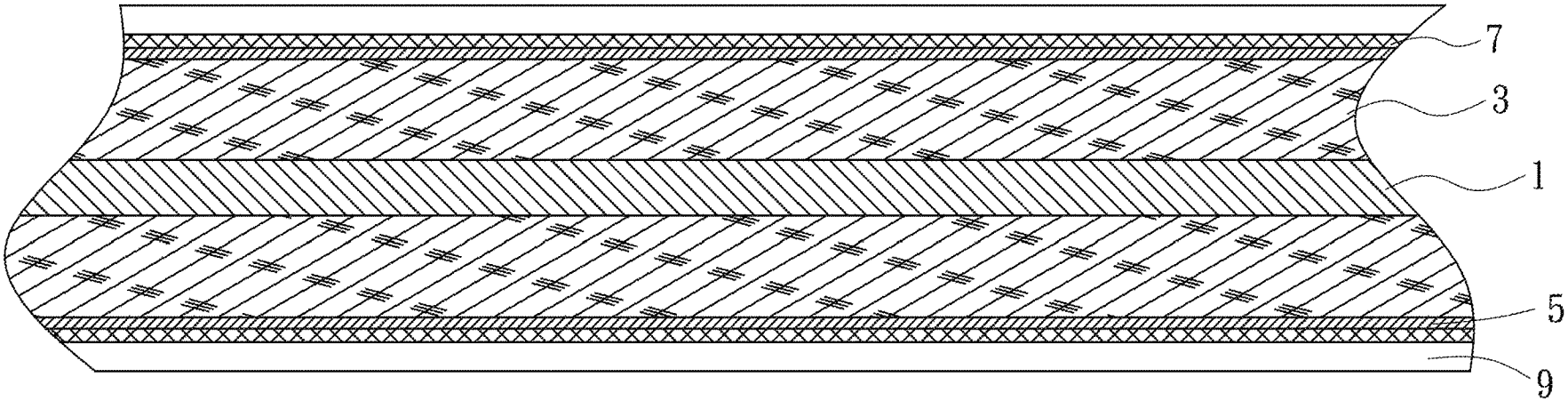
FIG. 3 is a cross-sectional view illustrating a coaxial cable according to various embodiments.

FIG. 3 is a cross-sectional view illustrating a coaxial cable according to various embodiments. As shown in FIG. 3, the coaxial cable comprises a center conductor 1, dielectric 3, foil shield 5, braided shield 7, and jacket 9. In the embodiments, the material of the center conductor 1 may comprise copper, bismuth, silver, nickel, tin, gold, copper gold-alloy, copper tin-alloy, copper nickel-alloy, or good electrically conductive polymer, or non-metal conductors etc. In the embodiments, the material of the foil shield 5 may comprise an aluminum-containing metal layer, copper-containing metal layer, or conductive material-containing conductive layer, such as aluminum foil coatings, or copper foil coatings. The foil shield 5 has electrical shielding effect to reduce electrical interference. In the embodiments, the type of braided shield 7 may be a combination shield, tri-shield, or quad-shield etc. and the material of the braided shield 7 may be aluminum, aluminum-alloy, copper, or copper-alloy.

Figure 4B:
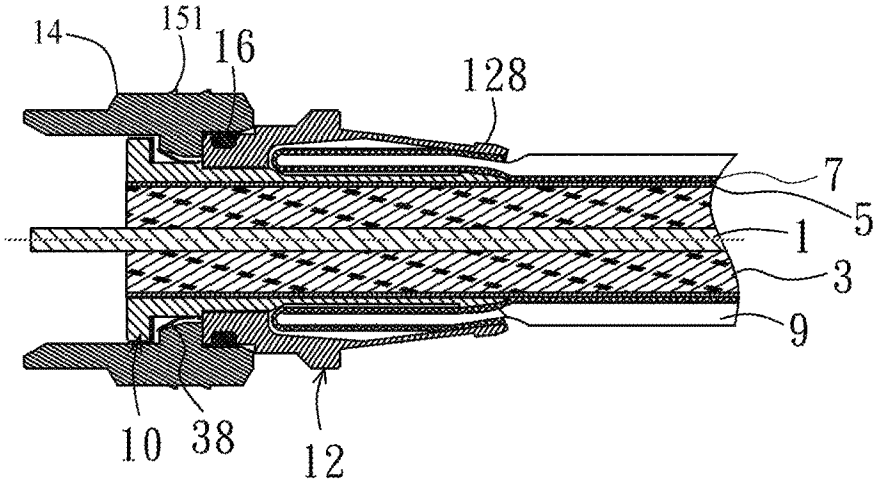
FIG. 4B is a cross-sectional view illustrating a coaxial cable connector without a sleeve according to various embodiments.
Figure 4A:
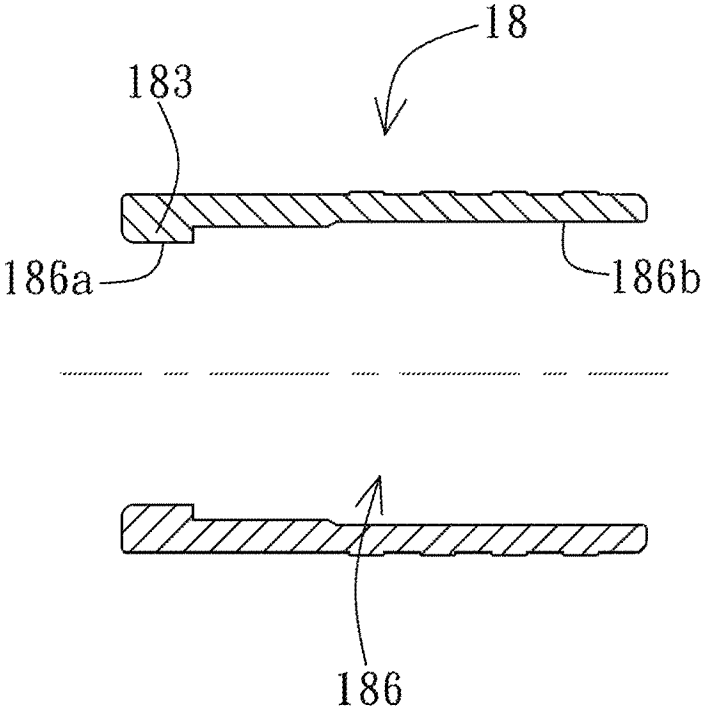
FIG. 4A is a cross-sectional sliced view illustrating a sleeve of a coaxial cable connector according to various embodiments.
Figure 4C:
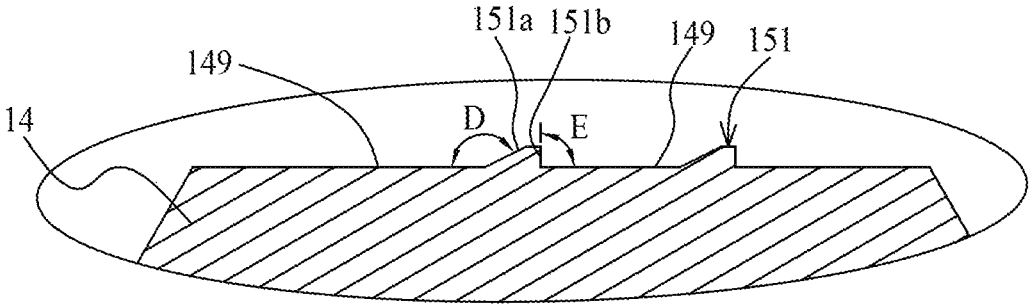
FIG. 4C is a cross-sectional enlarged view illustrating a plurality of engagement protrusions of a nut of a coaxial cable connector according to various embodiments.
Figure 4D:
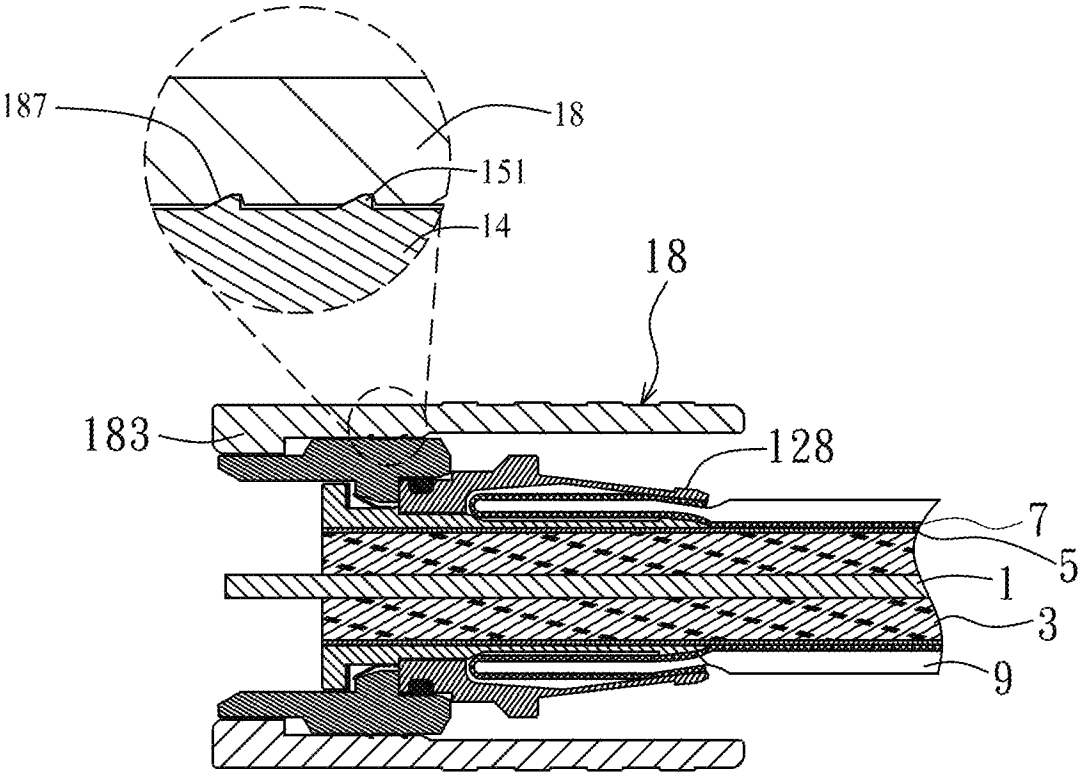
FIG. 4D is a cross-sectional view illustrating a coaxial cable connector according to various embodiments.

FIG. 4A is a cross-sectional sliced view illustrating a sleeve of a coaxial cable connector according to various embodiments. FIG. 4B is a cross-sectional view illustrating a coaxial cable connector without a sleeve according to various embodiments. FIG. 4C is a cross-sectional enlarged view illustrating a plurality of engagement protrusions of a nut of a coaxial cable connector according to various embodiments. FIG. 4D is a cross-sectional view illustrating a coaxial cable connector according to various embodiments. As shown in FIGS. 4A to 4D, and referring to FIGS. 1A to 1D, in the embodiment, each of the plurality of engagement protrusions 151 comprise a tapered side 151*a* and a distal side 151*b*, the tapered side 151*a*, positioned toward the proximal nut interior opening, has an outer angle D that is greater than an outer angle E of the distal side 151*b*. The annular flange 12 has a proximal flange engagement end 124 surrounding a proximal flange interior opening, proximal channel 111, first proximal outer surface 130, second proximal outer surface 132, a central outer annular flange 126, and a distal flange end 128 surrounding a distal flange interior opening 122. The sleeve 18 has a proximal sleeve engagement portion 183 surrounding a proximal sleeve interior opening and a distal sleeve interior portion 186*b* surrounding a distal sleeve interior opening 186. The proximal sleeve engagement portion 183 comprises a proximal sleeve interior portion 186*a*.

In an alternative embodiment, the coaxial cable connector further comprises an o-ring 16 assembled within the proximal channel 111 of the annular flange 12 for waterproof sealing. When assembled, the o-ring 16 completely encompasses all of the space of the proximal channel 111 of the annular flange 12, and is deformed due the pressure from the distal nut end portion 148 of the nut 14. Material of the o-ring 16 may comprise rubber material, soft polymaterial, other elastic and waterproof sealing polymaterial, or the like etc.

In the embodiments, when assembled, a proximal portion of the jacket 9 is removed and the center conductor 1, dielectric 3, and foil shield 5 is inserted into the distal post tapered end 112 of the post 10. The center conductor 1 extends flush with the proximal nut interior opening surrounded by the threaded portion 146 of the nut 14. The dielectric 3 and foil shield 5 lies flush with the proximal post interior opening surrounded by the proximal post engagement portion 104. During assembly, a lengthier portion of the braided shield 7 is folded backward to cover a portion of the jacket 9 corresponding to the annular space formed between the proximal flange engagement end 124 and distal flange end 128 of the annular flange 12 and post outer surface 110 and distal post tapered end 112 of the post 10, following a force applied to the distal flange end 128 of the annular flange 12 via assembly to the post 10 and nut 14.

In the embodiments, the tapered side 151*a* of each of the plurality of engagement protrusions 151 of the nut 14 is positioned toward the proximal nut interior opening, and has an outer angle D that is greater than an outer angle E of the distal side 151*b* of each of the plurality of engagement protrusions 151. Due to the smaller diameter of the proximal sleeve interior portion 186*a* of the sleeve 18 in relation to the plurality of nut sides 149 and the outer angles of the tapered and distal sides 151*a*, 151*b*, when the nut 14 is assembled to the sleeve 18 via the distal sleeve interior opening 186 of the sleeve 18, the main direction of assembly is assured to be from the tapered side 151*a* of each of the plurality of engagement protrusions 151 of the nut 14, positioned toward the proximal nut interior opening, and not the distal side 151*b*.

In the embodiments, the shape of the tapered and distal sides 151*a*, 151*b* of the plurality of engagement protrusions 151 is triangular prism-shaped; however, the embodiments are not limited thereto. The shape of the tapered and distal sides 151*a*, 151*b* of the plurality of engagement protrusions 151 may be conical-shaped, triangular-shaped, hook-shaped, square, convex-shaped or the like.

In the embodiments, the outer angle D of the tapered side 151*a* of the plurality of engagement protrusions 151, positioned toward the proximal nut interior opening, may be between 90° degrees to 160° degrees, between 105° degrees to 170° degrees, between 120° degrees to 150° degrees, and between 110° degrees to 150° degrees. The outer angle E of the distal side 151*b* of the plurality of engagement protrusions 151 may be between 0° degrees to 90° degrees, between 20° degrees to 80° degrees, between 30° degrees to 60° degrees, and between 40° degrees to 60° degrees.

Figure 5:
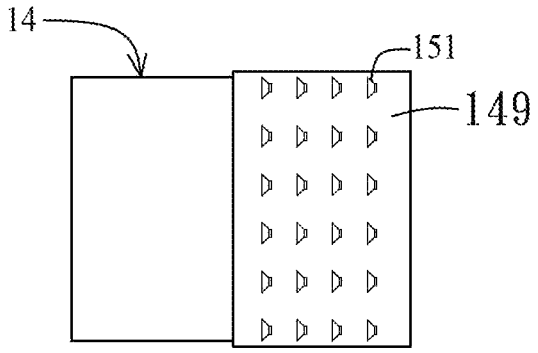
FIG. 5 is a perspective view illustrating a plurality of engagement protrusions of an alternative nut of a coaxial cable connector according to various embodiments.
Figure 6:
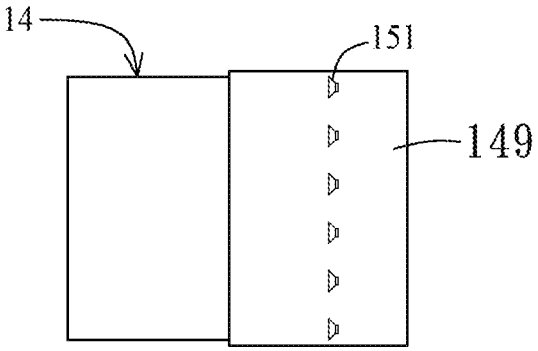
FIG. 6 is a perspective view illustrating a plurality of engagement protrusions of another alternative nut of a coaxial cable connector according to various embodiments.

FIG. 5 is a perspective view illustrating a plurality of engagement protrusions of an alternative nut of a coaxial cable connector according to various embodiments. FIG. 6 is a perspective view illustrating a plurality of engagement protrusions of another alternative nut of a coaxial cable connector according to various embodiments. As shown in FIGS. 5 and 6, as an example and not to be limiting, when the nut 14 is a conical nut, the plurality of engagement protrusions 151, comprising the tapered and distal sides 151*a*, 151*b*, the tapered side 151*a*, positioned toward the proximal nut interior opening, having an outer angle D that is greater than an outer angle E of the distal side 151*b*, may be annularly positioned along the circumference of the nut 14. In the embodiments, one or four sets of annularly positioned plurality of engagement protrusions 151 may be employed; however, the embodiments are not limited thereto. Any number of sets may be employed, continuously, or non-continuously, in any arrangement, so long as the indentations 187 are formed on the inner surface of the sleeve 18 via the plurality of engagement protrusions 151 of the nut 14.

In another alternative embodiment, the angle of the tapered side of the plurality of engagement protrusions 151 is between 105° degrees to 170° degrees.

In an alternative embodiment, the distal sleeve interior opening 186 of the sleeve 18 is polygonal-shaped. In another alternative embodiment, the sleeve 18 further comprises a direction indicator 189 disposed on an outer surface of the proximal sleeve engagement portion 183.

In the embodiment, the annular flange 12 is assembled to the post 10, having the fixing washer 30 assembled thereto, and assembled to the nut 14, via the proximal flange interior opening. The post 10, fixing washer 30, nut 14 and annular flange 12, are assembled to the proximal sleeve interior portion 186*a* of the sleeve 18 via the distal sleeve interior opening 186. When assembled, the proximal flange engagement end 124 is tightly flush with the annular inward protrusion 144 of the nut 14 and post ridge 106 and post outer surface 110 of the post 10. An annular space is formed between the proximal flange engagement end 124 and distal flange end 128 of the annular flange 12 and post outer surface 110 and distal post tapered end 112 of the post 10. A plurality of deformed indentations 187 is formed on an inner surface of the sleeve 18 via the plurality of engagement protrusions 151 of the nut 14.

In the embodiments, the coaxial cable connector comprises the fixing washer 30; however, the embodiments are not limited thereto. In an alternative embodiment, the coaxial cable connector comprises a sleeve 18, nut 14, post 10, and annular flange 12, and not the fixing washer 30, wherein the disposition and assembly of the post 10 to the nut 14, annular flange 12 to the post 10 and nut 14, and post 10, nut 14, and annular flange 12 to the sleeve 18, is as described previously, without the description of the fixing washer 30. As an example, in the embodiment, with no fixing washer assembled to the proximal post engagement portion 104 and proximal post outer surface 108 of the post 10, the post 10, alone, is assembled to the nut 14 via the proximal nut interior opening. When assembled, the proximal post engagement portion 104 of the post 10 is near to a protrusion ridge 145 of the nut 14 and the tapered protrusion surface 143 of the nut 14.

In an embodiment, a nut 14, configured as a part of a coaxial cable connector, comprising a plurality of nut sides 149 and a plurality of engagement protrusions 151 is provided. The plurality of nut sides 149 surrounds a distal nut interior opening 142, opposite a proximal nut interior opening. The plurality of engagement protrusions 151 are between the plurality of nut sides 149. Each of the plurality of engagement protrusions 151 comprises a tapered side 151*a* and a distal side 151*b*. The tapered side 151*a*, positioned toward the proximal nut interior opening, has an outer angle D that is greater than an outer angle E of the distal side 151*b*.

In the embodiment, the coaxial cable connector further comprises a sleeve 18, post 10, fixing washer 30, and annular flange 12. The post 10 has a proximal post engagement portion 104 surrounding a proximal post interior opening, proximal post outer surface 108, post ridge 106, post outer surface 110, and distal post tapered end 112 surrounding a distal post interior opening 102. The fixing washer 30 has a fixing washer ring 35 and a plurality of fixing appendages 36, wherein each of the plurality of fixing appendages 36 comprises an elastic wing 38 and an opening space 39.

In the embodiment, the fixing washer 30 is assembled to the proximal post engagement portion 104 and proximal post outer surface 108 of the post 10 via the distal post tapered end 112 and the post 10 and the fixing washer 30 are assembled to the nut 14 via the proximal nut interior opening. When assembled, the proximal post engagement portion 104 of the post 10 is near to a protrusion ridge 145 of the nut 14 and the elastic wing 38 of each of the plurality of fixing appendages 36 is in contact with the tapered protrusion surface 143 of the nut 14.

In an alternative embodiment, the plurality of fixing appendages 36 are perpendicular to the fixing washer ring 35, and the elastic wing 38 extends from a top portion of each of the plurality of fixing appendages 36 at an outward angle. Referring to FIGS. 2A to 2C, in alternative embodiments, the outward angle B of each of the extended elastic wing 38 of the plurality of fixing appendages 36 may be between 10° degrees to 20° degrees, between 15° degrees to 60° degrees, between 20° degrees to 25° degrees, and between 30° degrees to 75° degrees. Referring to FIGS. 1A to 1D, FIGS. 2A to 2C and 4A to 4D, when the fixing washer 30 is assembled to the post 10, the elastic wing 38 of each of the plurality of fixing appendages 36 are in contact with the tapered protrusion surface 143 of the nut 14, and when the nut 14 is moved, the outward angle of the elastic wing 38 is varied.

In the embodiment, the nut 14 further comprises an annular inward protrusion 144 having a protrusion ridge 145, a tapered protrusion surface 143, and a protrusion surface 147. The annular flange 12 has a proximal flange engagement end 124 surrounding a proximal flange interior opening, proximal channel 111, first proximal outer surface 130, second proximal outer surface 132, a central outer annular flange 126, and a distal flange end 128 surrounding a distal flange interior opening 122. The sleeve 18 has a proximal sleeve engagement portion 183 surrounding a proximal sleeve interior opening and a distal sleeve interior portion 186*b* surrounding a distal sleeve interior opening 186. The proximal sleeve engagement portion 183 comprises a proximal sleeve interior portion 186*a*.

In an alternative embodiment, the shape of the tapered and distal sides 151*a*, 151*b* of the plurality of engagement protrusions 151 is triangular prism-shaped. In another alternative embodiment, the angle of the tapered side of the plurality of engagement protrusions 151 is between 105° degrees and 170° degrees.

In an alternative embodiment, the distal sleeve interior opening 186 of the sleeve 18 is polygonal-shaped.

In the embodiment, the annular flange 12 is assembled to the post 10, having the fixing washer 30 assembled thereto, and assembled to the nut 14, via the proximal flange interior opening. The post 10, fixing washer 30, nut 14 and annular flange 12, are assembled to the proximal sleeve interior portion 186*a* of the sleeve 18 via the distal sleeve interior opening 186. When assembled, the proximal flange engagement end 124 is tightly flush with the annular inward protrusion 144 of the nut 14 and post ridge 106 and post outer surface 110 of the post 10. An annular space is formed between the proximal flange engagement end 124 and distal flange end 128 of the annular flange 12 and post outer surface 110 and distal post tapered end 112 of the post 10. A plurality of deformed indentations 187 is formed on an inner surface of the sleeve 18 via the plurality of engagement protrusions 151 of the nut 14.

In the embodiments, the coaxial cable connector comprises the fixing washer 30; however, the embodiments are not limited thereto. In an alternative embodiment of the nut 14, configured as a part of a coaxial cable connector, the coaxial cable connector comprises a sleeve 18, nut 14, post 10, and annular flange 12, and not the fixing washer 30, wherein the disposition and assembly of the post 10 to the nut 14, annular flange 12 to the post 10 and nut 14, and post 10, nut 14, and annular flange 12 to the sleeve 18, is as described previously, without the description of the fixing washer 30. As an example, in the embodiment, with no fixing washer 30 assembled to the proximal post engagement portion 104 and proximal post outer surface 108 of the post 10, the post 10, alone, is assembled to the nut 14 via the proximal nut interior opening. When assembled, the proximal post engagement portion 104 of the post 10 is near to a protrusion ridge 145 of the nut 14 and the tapered protrusion surface 143 of the nut 14.

In an embodiment, a sleeve 18, configured as a part of a coaxial cable connector, comprising a proximal sleeve engagement portion 183, distal sleeve interior portion 186*b*, first conical flat surface 182, second conical flat surface, first semi-arching surface, and second semi-arching surface is provided. The proximal sleeve engagement portion 183 surrounds a proximal sleeve interior opening, having a proximal sleeve interior portion 186*a*. The distal sleeve interior portion 186*b* surrounds a polygonal-shaped distal sleeve interior opening 186. The first conical flat surface 182 has a plurality of first bumps 188 thereon. The second conical flat surface, opposite the first conical flat surface 182, has a plurality of second bumps thereon. A first semi-arching surface between the first and second conical flat surfaces has a plurality of first semi-curved protrusions 184 thereon. The second semi-arching surface, opposite the first semi-arching surface, has a plurality of second semi-curved protrusions thereon.

In the embodiments, the sleeve 18 is integrally formed.

In the embodiments, the shape of the distal sleeve interior portion 186*b* surrounding the distal sleeve interior opening 186 corresponds to the polygonal-shaped head of the nut 14;

however, the embodiments are not limited thereto. If the nut 14 is a hex nut, square nut, ring nut, wing nut, or the like, the shape of the distal sleeve interior portion 186*b* surrounding the distal sleeve interior opening 186 would correspond to the appropriate shape of the head of the hex nut, square nut, ring nut, wing nut, or the like, respectively. So long as a plurality of deformed indentations 187 is formed on an inner surface of the sleeve 18 via the plurality of engagement protrusions 151 of the nut 14 and the nut 14 is turned by the sleeve 18.

In the embodiment, the coaxial cable connector further comprises a nut 14, a post 10, and an annular flange 12. The nut 14 has a plurality of nut sides 149 surrounding a distal nut interior opening 142, opposite a proximal nut interior opening, and a plurality of engagement protrusions 151 between the plurality of nut sides 149. Each of the plurality of engagement protrusions 151 comprises a tapered side 151*a* and a distal side 151*b*. The tapered side 151*a*, positioned toward the proximal nut interior opening, has an outer angle D that is greater than an outer angle E of the distal side 151*b*.

In an alternative embodiment, the nut 14 has a plurality of nut sides 149 surrounding a distal nut interior opening 142, opposite a proximal nut interior opening, and a plurality of engagement protrusions 151 between the plurality of nut sides 149. Each of the plurality of engagement protrusions 151 comprises a tapered side 151*a* and a distal side 151*b*. The tapered side 151*a*, positioned toward the proximal nut interior opening, has an outer angle D that is greater than an outer angle E of the distal side 151*b*. In another alternative embodiment, the shape of the tapered and distal sides 151*a*, 151*b* of the plurality of engagement protrusions 151 is triangular prism-shaped.

In the embodiment, the post 10 has a proximal post engagement portion 104 surrounding a proximal post interior opening, proximal post outer surface 108, post ridge 106, post outer surface 110, and distal post tapered end 112 surrounding a distal post interior opening 102. The annular flange 12 has a proximal flange engagement end 124 surrounding a proximal flange interior opening, proximal channel 111, first proximal outer surface 130, second proximal outer surface 132, a central outer annular flange 126, and a distal flange end 128 surrounding a distal flange interior opening 122. In an embodiment, the nut 14 further comprises an annular inward protrusion 144 having a protrusion ridge 145, a tapered protrusion surface 143, and a protrusion surface 147.

In the embodiment, the post 10 is assembled to the nut 14 via the proximal nut interior opening. When assembled, the proximal post engagement portion 104 is near to a protrusion ridge 145 of the nut 14. The annular flange 12 is assembled to the post 10 and the nut 14 via the proximal flange interior opening of the annular flange 12. When assembled, the proximal flange engagement end 124 is tightly flush with the annular inward protrusion 144 of the nut 14 and post ridge 106 and post outer surface 110 of the post 10. An annular space is formed between the proximal flange engagement end 124 and distal flange end 128 of the annular flange 12 and post outer surface 110 and distal post tapered end 112 of the post 10. The nut 14, post 10, and annular flange 12 are assembled to the proximal sleeve interior portion 186*a* of the sleeve 18 via the distal sleeve interior opening 186. When assembled, a plurality of deformed indentations 187 is formed on an inner surface of the sleeve 18 via the plurality of engagement protrusions 151 of the nut 14.

Conventional coaxial cable connectors generally comprise a connector body having a post which is able to house a coaxial cable therethrough, a nut, rotatably coupled to the post, mounting the conventional coaxial cable connector to an apparatus or device having a mounting means built therein, and an annular flange, between the post and nut.

The post of conventional coaxial cable connectors, generally comprise a coaxial cable receiving end, receiving a coaxial cable therethrough and a coaxial cable connecting end, opposite thereto. The nut of conventional coaxial cable connectors, generally further comprise internal threads, at the coaxial cable connecting end, having a width compatible for mounting the conventional coaxial cable connectors to an apparatus or device having a mounting means built therein.

Conventional coaxial cable connectors generally further comprise a sleeve, securing the coaxial cable positioned within the connector body of the conventional coaxial cable connector. The sleeve of conventional coaxial cable connectors is basically formed of an elastic plastic material and is fixed to the connector body of the conventional coaxial cable connector. In short, the conventional coaxial cable connector is a fixed-type structural sleeve design having a rotatable nut.

In the embodiments, a coaxial cable connector comprising a sleeve, nut, post, and annular flange is provided. When the post is assembled to the nut, the annular flange to the post, and post, annular flange and nut to the sleeve, a proximal post engagement portion of the post is near to a protrusion ridge of the nut, and a proximal flange engagement end of the annular flange is flush with an annular inward protrusion of the nut and post ridge and post outer surface of the post. An annular space is formed between the proximal flange engagement end and a distal flange end of the annular flange and post outer surface and a distal post tapered end of the post. A plurality of deformed indentations is formed on an inner surface of the sleeve via a plurality of engagement protrusions of the nut, each having a tapered side and a distal side.

The embodiments provide a sleeve, configured as a part of the coaxial cable connector, comprising a first conical flat surface having a plurality of first bumps thereon and a second conical flat surface, opposite the first conical flat surface, also having a plurality of second bumps thereon. The sleeve further comprises a first semi-arching surface between the first and second conical flat surfaces, having a plurality of first semi-curved protrusions thereon and a second semi-arching surface, opposite the first semi-arching surface, also having a plurality of second semi-curved protrusions thereon. The embodiments also provide a nut, also configured as a part of the coaxial cable connector, comprising a plurality of engagement protrusions between a plurality of nut sides, each, comprising a tapered side and a distal side. When the nut is assembled to the sleeve, a plurality of deformed indentations is formed on an inner surface of the sleeve via the plurality of engagement protrusions of the nut. The plurality of first and second bumps and the plurality of first and second semi-curved protrusions provide easy gripping and turning of the sleeve, in the direction of the direction indicator, while the nut is turned by the sleeve via the plurality of engagement protrusions of the nut. In an embodiment, the sleeve further comprises a direction indicator, indicating a turning direction of the sleeve for visual display and touch direction indication.

Unless otherwise indicated, all numbers used herein to express quantities, dimensions, and so forth used should be understood as being modified in all instances by the term "about." The use of the singular includes the plural unless specifically stated otherwise, and use of the terms "and" and "or" means "and/or" unless otherwise indicated.

From the foregoing it will be appreciated that, although specific embodiments have been described herein for purposes of illustration, various modifications can be made without deviating from the spirit and scope of the disclosure. Furthermore, where an alternative is disclosed for a particular embodiment, this alternative can also apply to other embodiments even if not specifically stated.

What is claimed is:

1. A coaxial cable connector, comprising:

a sleeve having a proximal sleeve engagement portion surrounding a proximal sleeve interior opening and a distal sleeve interior portion surrounding a distal sleeve interior opening, wherein the proximal sleeve engagement portion comprises a proximal sleeve interior portion;

a nut having a plurality of nut sides surrounding a distal nut interior opening, opposite a proximal nut interior opening, a plurality of engagement protrusions between the plurality of nut sides, and an annular inward protrusion having a protrusion ridge, a tapered protrusion surface, and a protrusion surface, wherein each of the plurality of engagement protrusions comprise a tapered side and a distal side, the tapered side, positioned toward the proximal nut interior opening, having an outer angle that is greater than an outer angle of the distal side;

a post having a proximal post engagement portion surrounding a proximal post interior opening, proximal post outer surface, post ridge, post outer surface, and distal post tapered end surrounding a distal post interior opening; and an annular flange having a proximal flange engagement end surrounding a proximal flange interior opening, proximal channel, first proximal outer surface, second proximal outer surface, a central outer annular flange, and a distal flange end surrounding a distal flange interior opening, wherein the post is assembled to the nut via the proximal nut interior opening, whereby the proximal post engagement portion is near to the protrusion ridge of the nut, and the annular flange is assembled to the post and the nut via the proximal flange interior opening of the annular flange, whereby the proximal flange engagement end is flush with the annular inward protrusion of the nut and post ridge and post outer surface of the post, and an annular space is formed between the proximal flange engagement end and distal flange end of the annular flange and post outer surface and distal post tapered end of the post, and wherein the nut is assembled to the proximal sleeve interior portion of the sleeve via the distal sleeve interior opening, and when assembled, a plurality of deformed indentations is formed on an inner surface of the sleeve via the plurality of engagement protrusions of the nut.

2. The coaxial cable connector of claim 1, further comprising:

a fixing washer having a fixing washer ring and a plurality of fixing appendages, wherein each of the plurality of fixing appendages comprises an elastic wing and an opening space, wherein the fixing washer is assembled to the proximal post engagement portion and proximal post outer surface of the post via the distal post tapered end, and the elastic wing of each of the plurality of fixing appendages is in contact with the tapered protrusion surface of the nut.

3. The coaxial cable connector of claim 2, wherein the plurality of fixing appendages are perpendicular to the fixing washer ring, and the elastic wing extends from a top portion of each of the plurality of fixing appendages at an outward angle, whereby when the elastic wing of each of the plurality of fixing appendages are in contact with the tapered protrusion surface of the nut and the nut is moved, the outward angle thereof is varied.

4. The coaxial cable connector of claim 1, wherein the distal sleeve interior opening of the sleeve is polygonal-shaped.

5. The coaxial cable connector of claim 1, wherein the shape of the tapered and distal sides of the plurality of engagement protrusions is triangular prism-shaped.

6. The coaxial cable connector of claim 1, wherein the angle of the tapered side of the plurality of engagement protrusions is between 105° degrees and 170° degrees.

7. The coaxial cable connector of claim 1, wherein the sleeve further comprises a direction indicator disposed on an outer surface of the proximal sleeve engagement portion.

8. A nut, configured as a part of a coaxial cable connector, comprising:

a plurality of nut sides surrounding a distal nut interior opening, opposite a proximal nut interior opening;

a plurality of engagement protrusions between the plurality of nut sides, wherein each of the plurality of engagement protrusions comprise a tapered side and a distal side, the tapered side, positioned toward the proximal nut interior opening, having an outer angle that is greater than an outer angle of the distal side; and an annular inward protrusion having a protrusion ridge, a tapered protrusion surface, and a protrusion surface, wherein the coaxial cable connector comprises a Post having a proximal post engagement portion surrounding a proximal post interior opening, proximal post outer surface, post ridge, post outer surface, and distal post tapered end surrounding a distal post interior opening, and an annular flange having a proximal flange engagement end surrounding a proximal flange interior opening, proximal channel, first proximal outer surface, second proximal outer surface, a central outer annular flange, and a distal flange end surrounding a distal flange interior opening, and wherein the post is assembled to the nut via the proximal nut interior opening, whereby the proximal post engagement portion is near to the protrusion ridge of the nut, and the annular flange is assembled to the post and the nut via the proximal flange interior opening of the annular flange, whereby the proximal flange engagement end is flush with the annular inward protrusion of the nut and post ridge and post outer surface of the post, and an annular space is formed between the proximal flange engagement end and distal flange end of the annular flange and post outer surface and distal post tapered end of the post.

9. The nut, configured as a part of a coaxial cable connector of claim 8, wherein the coaxial cable connector further comprises:

a fixing washer having a fixing washer ring and a plurality of fixing appendages, wherein each of the plurality of fixing appendages comprises an elastic wing and an opening space, wherein the fixing washer is assembled to the proximal post engagement portion and proximal post outer surface of the post via the distal post tapered end, and the elastic wing of each of the plurality of fixing appendages is in contact with the tapered protrusion surface of the nut.

10. The nut, configured as a part of a coaxial cable connector of claim 9, wherein the plurality of fixing appendages are perpendicular to the fixing washer ring, and the elastic wing extends from a top portion of each of the plurality of fixing appendages at an outward angle, whereby when the elastic wing of each of the plurality of fixing appendages are in contact with the tapered protrusion surface of the nut and the nut is moved, the outward angle thereof is varied.

11. The nut, configured as a part of a coaxial cable connector of claim 8, wherein the coaxial cable connector further comprises a sleeve having a proximal sleeve engagement portion surrounding a proximal sleeve interior opening and a distal sleeve interior portion surrounding a distal sleeve interior opening, wherein the proximal sleeve engagement portion comprises a proximal sleeve interior portion, and wherein the nut is assembled to the proximal sleeve interior portion of the sleeve via the distal sleeve interior opening, and when assembled, a plurality of deformed indentations is formed on an inner surface of the sleeve via the plurality of engagement protrusions of the nut.

12. The nut, configured as a part of a coaxial cable connector of claim 11, wherein the distal sleeve interior opening of the sleeve is polygonal-shaped.

13. The nut, configured as a part of a coaxial cable connector of claim 8, wherein the shape of the tapered and distal sides of the plurality of engagement protrusions is triangular prism-shaped.

14. The nut, configured as a part of a coaxial cable connector of claim 8, wherein the angle of the tapered side of the plurality of engagement protrusions is between 105° degrees and 170° degrees.

15. A sleeve, configured as a part of a coaxial cable connector, comprising:

a proximal sleeve engagement portion surrounding a proximal sleeve interior opening, having a proximal sleeve interior portion;

a distal sleeve interior portion surrounding a polygonal-shaped distal sleeve interior opening;

a first conical flat surface having a plurality of first bumps thereon;

a second conical flat surface, opposite the first conical flat surface, having a plurality of second bumps thereon;

a first semi-arching surface between the first and second conical flat surfaces having a plurality of first semi-curved protrusions thereon; and a second semi-arching surface, opposite the first semi-arching surface, having a plurality of second semi-curved protrusions thereon, wherein the coaxial cable connector comprises a nut having a plurality of nut sides surrounding a distal nut interior opening, opposite a proximal nut interior opening, and a plurality of engagement protrusions between the plurality of nut sides, wherein each of the plurality of engagement protrusions comprise a tapered side and a distal side, the tapered side, positioned toward the proximal nut interior opening, having an outer angle that is greater than an outer angle of the distal side, a post having a proximal post engagement portion surrounding a proximal post interior opening, proximal post outer surface, post ridge, post outer surface, and distal post tapered end surrounding a distal post interior opening, an annular flange having a proximal flange engagement end surrounding a proximal flange interior opening, proximal channel, first proximal outer surface, second proximal outer surface, a central outer annular flange, and a distal flange end surrounding a distal flange interior opening, and an annular inward protrusion having a protrusion ridge, a tapered protrusion surface, and a protrusion surface, and wherein the post is assembled to the nut via the proximal nut interior opening, whereby the proximal post engagement portion is near to the protrusion ridge of the nut, and the annular flange is assembled to the cost and the nut via the proximal flange interior opening of the annular flange, whereby the proximal flange engagement end is flush with the annular inward protrusion of the nut and post ridge and post outer surface of the post, and an annular space is formed between the proximal flange engagement end and distal flange end of the annular flange and post outer surface and distal post tapered end of the post, and the nut, having the post and the annular flange assembled thereto, is assembled to the proximal sleeve interior portion of the sleeve via the distal sleeve interior opening, and when assembled, a plurality of deformed indentations is formed on an inner surface of the sleeve via the plurality of engagement protrusions of the nut.

16. The sleeve, configured as a part of a coaxial cable connector of claim 15, wherein the shape of the tapered and distal sides of the plurality of engagement protrusions is triangular prism-shaped.

* * * * *